United States Patent [19]

Fischer et al.

[11] 4,386,263

[45] May 31, 1983

[54] ELECTRIC COOKER PLATE WITH A SWITCH FOR PREVENTING OVERHEATING

[75] Inventors: Karl Fischer, Am Gänsberg 23, D-7519 Oberderdingen, Fed. Rep. of Germany; Felix Schreder, Oberderdingen, Fed. Rep. of Germany

[73] Assignee: Karl Fischer, Oberderdingen, Fed. Rep. of Germany

[21] Appl. No.: 285,144

[22] Filed: Jul. 20, 1981

[30] Foreign Application Priority Data

Jul. 24, 1980 [DE] Fed. Rep. of Germany ..... 3027998

[51] Int. Cl.[3] ..... H05B 3/68

[52] U.S. Cl. ..... 219/449; 219/452; 219/512; 337/365; 337/386

[58] Field of Search ..... 219/449, 450, 451, 452, 219/494, 512, 448; 337/386, 362, 365

[56] References Cited

U.S. PATENT DOCUMENTS

| | | | |
|---|---|---|---|
| 4,122,330 | 10/1978 | Fischer et al. | 219/449 |
| 4,135,081 | 1/1979 | Fisher | 219/449 |

FOREIGN PATENT DOCUMENTS

| | | | |
|---|---|---|---|
| 214543 | 4/1961 | Austria | 219/449 |
| 2343834 | 4/1975 | Fed. Rep. of Germany | 219/449 |
| 2422624 | 11/1975 | Fed. Rep. of Germany | 219/449 |
| 2735426 | 2/1979 | Fed. Rep. of Germany | 219/449 |
| 86738 | 11/1955 | Norway | 219/449 |
| 1212941 | 11/1970 | United Kingdom | 219/449 |

*Primary Examiner*—Volodymyr Y. Mayewsky
*Attorney, Agent, or Firm*—Steele, Gould & Fried

[57] ABSTRACT

An electric hot plate has an overheating safety switch having a steatite housing which is inserted into the lower sheet cover plate of the hot plate and is supported with two feet on the lower side of the heating elements of the hot plate. A bimetallic member is positioned parallel between these feet which acts on a snap switch positioned in the steatite housing via a transmission rod. The transmission rod is continuously pressed against the snap switch by a plate spring and a guide on the snap switch. As a result of this, it is fixed precisely in its position. The overheating safety switch simultaneously forms the lead-through passages for the electric hot plate connections.

11 Claims, 5 Drawing Figures

ELECTRIC COOKER PLATE WITH A SWITCH FOR PREVENTING OVERHEATING

FIELD OF THE INVENTION

This invention relates to an electric cooker plate having a switch for preventing overheating

BACKGROUND OF THE INVENTION

In German Pat. No. 1,615,258 (equivalent to British Pat. No. 1,212,941), an overheating safety switch is inserted into the lower hot plate cover and has a ceramic housing, inside which are positioned a bimetallic strip and a snap switch. The safety switch is supported with its housing on the lower side of the hot plate. In addition to its connection to the mains supply, it has hot plate attachments for other hot plate connections, so that it simultaneously forms the passage for the connection through the hot plate cover. In German Gebrauchsmuster No. 6,803,971, the attachments are designed as openings in the housing.

German Offenlegungsschrift No. 2,735,426 (equivalent to U.S. Pat. No. 4,153,833) describes an overheating safety switch which simultaneously contains the connections, for example, screw connections of the hot plate and is attached externally onto the hot plate. A separate part is inserted into the cover for the lead-through passage of the hot plate connections. A curved bimetallic member projects through the lower cover into the chamber below the hot plate and transmits its working motion through a compression bar to the switch in the housing.

A comparable arrangement is known from German Pat. No. 2,620,004 (equivalent to British Pat. No. 1,577,367) and U.S. Pat. No. 4,122,330.

A safety switch is known from German Pat. No. 1,123,059 which consists of a small ceramic hollow body in which a snap switch is inserted and is influenced by a bimetallic strip. It is positioned in the unheated center of the hot plate. The bimetallic strip and the switch are positioned in the housing which is located on the lower side of the hot plate.

SUMMARY OF THE INVENTION

The object of the present invention is to provide a hot plate having an overheating safety switch, in which the responsiveness is improved and the thermal inertia is reduced, through simple production techniques, so that the overheating safety switch responds more rapidly and precisely to an increase or drop in temperature of the hot plate.

According to the invention there is provided an electric hot plate having an overheating safety switch which rests on the lower heated side of the hot plate and is positioned in the heated annular part of the plate. The safety switch comprises a bimetallic strip, a snap switch actuatable by the bimetallic strip and mounted in a chamber inside an extended housing, the housing projecting through a cover covering the lower side of the hot plate body, the safety switch being applied onto the lower side of the hot plate by this cover and having connections for the switch and at least one lead-through passage for at least one connection line of the hot plate which is not connected by the switch. The bimetallic strip is positioned outside the housing of the safety switch in an open chamber formed between housing projections which rest with their ends against the lower side of the hot plate body. The bimetallic strip extends lengthwise to the housing longitudinal extension and acts on a transmission member projecting through a housing opening and transmitting deflection of the bimetallic strip to the snap switch.

In use of the invention it is possible to expose only the bimetallic strip to the heat of the hot plate, while the actual switch remains protected from too severe thermal influences inside the housing. Moreover, since only the bimetallic strip is heated by the radiant heat of the hot plate and since this strip has a smaller mass, the bimetallic strip also responds more rapidly. In addition thereto, the chamber accommodating the strip may be small and may be sealed off relatively tightly.

The overheating safety switch simultaneously forms the lead through part, by which in addition to the connections connected to the switch, the other hot plate connections are also fixed and are passed through the lower hot plate cover inside the heated annular chamber of the hot plate. In this arrangement, the housing is preferably supported with one shoulder on the edge of an opening of the cover and it stands with housing projections which are preferably designed as relatively thin feet on both narrow sides of the housing, on the lower side of the hot plate. As a result of this measure, a well ventilated free chamber is produced in which the bimetallic member is positioned and is thus exposed to the radiant heat and to convection. Since it is hardly enclosed by the ceramic housing of the overheating safety switch, the bimetallic member follows the temperature of the heating in a much improved manner, so that the overheating safety switch is not a time function element, as was the case in the previous designs, but it is a genuine temperature switch. Once the previous overheating safety switches had been switched off, they needed so much time to re-connect, due to the great heat inertia and to the inertia of the switching behaviour, that during normal operations, the hot plate was only operated with a part of its power and did not have a sufficient output.

According to the preferred embodiment of the present invention, the construction of the switch may be particularly simple, when the housing is designed in two parts, consisting of a base part and a cover part. In the base part, the chamber is positioned in the form of a recess open at the sides which is sealed by the cover part attached onto the sides. In this arrangement, the cover part may preferably have the housing projections which rest on the lower side of the hot plate. In this manner, it is possible to fix the component parts of the switch and the bimetallic member by inserting them laterally into slits of the base part of the housing and to secure them by fitting the cover part. The ceramic parts are shaped very simply, which facilitates the production thereof from steatite.

The mass of the overheating safety switch housing which is present in the vicinity of the heating and below the cover may particularly be kept low due to the construction of the switch. This measure not only has the advantage which has already been explained, that the switch responds more rapidly, but it also ensures that when the hot plate heats up, these parts also heat up rapdily and thus, a cold condensation point is not produced on which condensation water, which increases the leakage current, could be deposited.

The design is also very advantageous with respect to the switch, because the switch, which is preferably designed as a snap switch with a clamped spring tongue, is loaded by a contact pressure spring in the normal on-position, and the transmission member is always maintained in a definite position, which prevents displacement or tilting. Only when the switch responds does the transmission member engage with the bimetallic snap mechanism and cause a disconnection, the forces of the bimetallic member and the prestressed spring adding together.

Further features, details and advantages will be apparent from the following description of the preferred embodiments of the present invention.

BRIEF DESCRIPTION OF THE DRAWINGS

In both variations, the same reference numbers characterise the same parts and will not be described again.

DETAILED DESCRIPTION OF PREFERRED EMBODIMENTS

Figure 1:
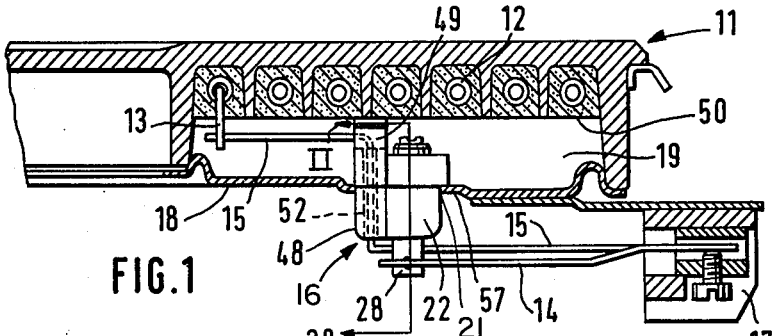
FIG.1 illustrates a partial section through an electrical hot plate having an overheating safety switch.

FIG. 1 illustrates a conventional hot plate 11 having a cast iron body which, on its lower side has spiral grooves separated by ribs. Heating means are positioned in those grooves, the heating means comprising heating resistors embedded in a mass of insulating material. Between the lower side 50 of the heating means, i.e. the insulating material in which the heating resistors are embedded, and a lower cover 18 sealing off the hot plate, is formed a heated annular chamber 19 into which projects an overheating safety switch 16. The housing 22 of the overheating switch projects through an opening 21 in the cover 18 and is supported on this cover 18 by shoulders 57. As a result of this measure, the cover presses the switch, with the free ends of housing projections 49, against the lower side 50 of the hot plate, i.e. the lower side of the heating in the heated annular chamber 19.

Figure 3:
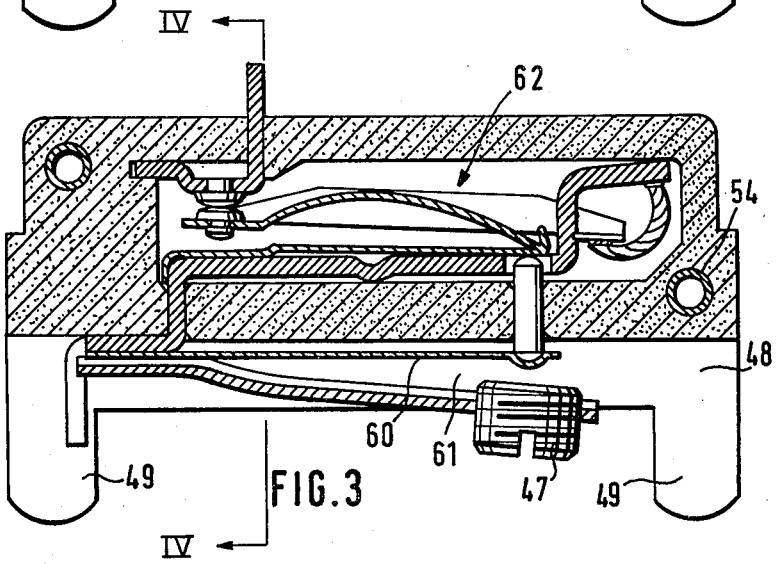
FIG. 3 illustrates a section corresponding to FIG. 2 in a normal connected condition.
Figure 4:
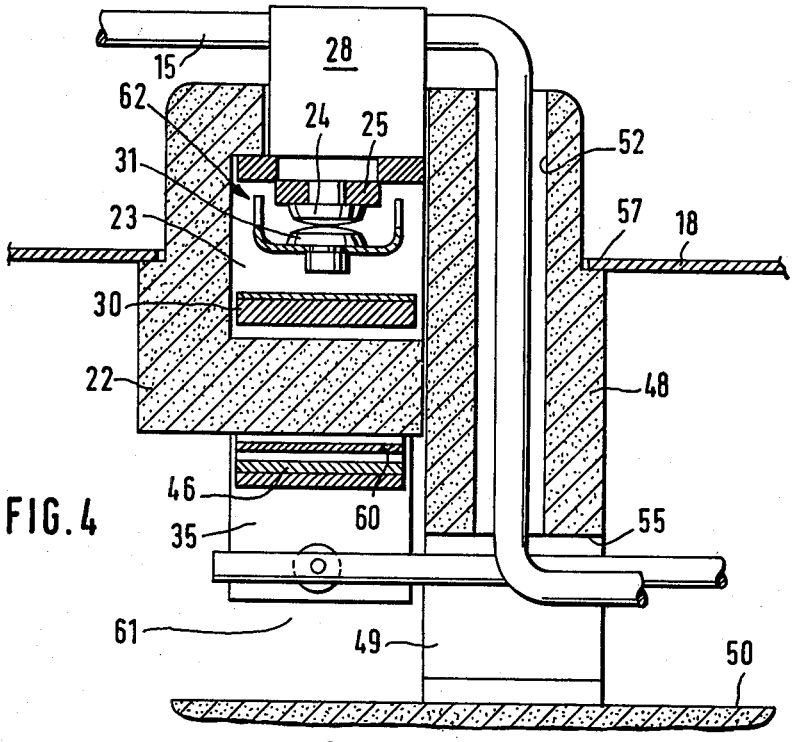
FIG. 4 illustrates a section along line IV—IV in FIG. 3.

As may be seen from FIGS. 1 and 4, the overheating safety switch 16 is electrically connected to a connecting wire 14 by a connecting cover plate 28 connecting wire 14 leads to a conventional connection piece 17 which is positioned slightly outside the hot plate on a holding sheet. A connecting cover plate 35 which may be seen in FIGS. 2 and 3, on the side of the overheating safety switch positioned in the interior chamber 19, is connected to a heating resistor 12.

The connection to the heating resistors 12 follows in conventional manner via connection pins 13 projecting out of the embedding mass, and connection lines 15 are welded to these pins. It may be seen that in addition to its own electrical connections via the connecting cover plates 28 and 35 to fix and guide the other connection wires 15, the overheating safety switch also has lead-through passages 52 in the form of several openings or holes provided in the housing 22. The connecting wires 15 project through these openings or holes, so that the overheating safety switch simultaneously performs the task of an insulating lead-through passage through the lower cover 18.

Figure 2:
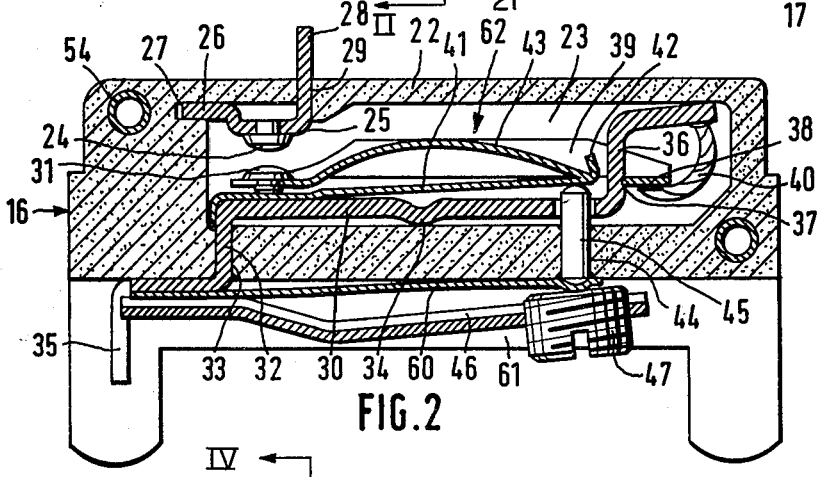
FIG. 2 illustrates an inverted and enlarged section through the overheating safety switch along line II—II in FIG. 1, while disconnected.

The construction of the overheating safety switch 16 is illustrated in detail in FIGS. 2 to 4. FIG. 2 illustrates the open or disconnected position and FIG. 3 illustrates the normal closed connected position of the switch. The switch has a housing 22, the base part 53 of which has an extended internal recess 23 which is open at the sides. The housing 22 is closed on the top and it is sealed off at the sides by a cover part 48, the parts of which projecting over the base part 53 form the housing projections 49 in the form of feet which project downwards and are positioned near the narrow sides of the housing. The stationary contact 24 of a snap switch 62 is positioned on the center part of a flat constructional element 25, the left-hand end 26 of which extends in a slit 27 which is open on one side and the outer end 28 of which, bent at a right angle, extends outwards through a slit 29 in the housing 22. The outer end 28 forms a connecting cover plate.

The current is supplied to the movable contact 31 of the snap switch 62 via an extended snap switch support 30 which is bent in an approximate right angle at four locations and the part 32 of which is fixed by insertion into a continuous slot or slit 33. To prevent the snap switch support 30 from wobbling, the support 30 has an outward bend 34 approximately in its center, with which it is supported against the wall of the recess 33. The outer end 35 of the component part 30 also forms a connecting cover plate. A notch 37 is made in the region of the right-hand end 36 of the snap switch support 30, and the sharp edge 38 of the snap switch lever 39 is mounted in this notch. The end of the snap switch lever 39 associated with the sharp edge 38 is conductively connected to the end of the snap switch support 30 via a metallic stranded wire 40 which is soldered thereon.

A resilient tongue 41 is connected to the snap switch support 30 and this tongue is prestressed such that it rests on the snap switch support 30 when it is not loaded. The free end 42 of the tongue 41 is bent round to form an acute angle, the free end of the snap switch spring 43 engaging in this acute angle. A pin 45 inserted with clearance in a bore 44 of the housing 22 engages the tongue 41 on the side of the tongue opposite the snap switch spring 43. The tongue 41 normally rests on the snap switch support 30 due to the pretension of the tongue. A plate spring 60 extends parallel to the bimetallic member 46 and has a depression accommodating the pin 45, pin 45 is held in contact with the tongue 41, so that it always occupies a definite position and cannot tilt. The other end of the pin 45 is engaged indirectly by the bimetallic strip 46, spring plate 60 transmitting the motion. One end of the bimetallic strip 46 is welded onto the section of the snap switch support 30 which lies outside the housing 22. The narrowly hatched region in FIGS. 2 and 3 represents the part of the bimetallic strip which has the greater thermal expansion coefficient. An adjusting screw 47 is inserted into the free end of the bimetallic strip 46. The opening or closing temperature of the overheating safety switch 16 may be adjusted using this screw 47.

When the temperature rises, the bimetallic strip 46 is bent such that its free end is pivoted upwards from below in FIG. 2, and this movement is transmitted by the pin 45 to the tongue 41 and thus to the right-hand end of the snap switch spring 43. As soon as the right-hand end of the snap switch spring 43 approximately surpasses the height of the sharp edge 38 during this movement, the snap switch lever 39 snaps into the position illustrated in FIG. 2, in which the two contacts 24 and 31 are at a distance from each other and thus, the circuit is opened.

When the temperature drops, the bimetallic strip 46 bends again downwards until it reaches the position illustrated in FIG. 3, in which the switch is closed.

As may be seen in particular from FIG. 4, the cover part 48 covers the recess 23 of the base part 53 and it is secured thereto by means of attachment rivets 54 (FIGS. 2 and 3). This prevents the metallic component parts of the switch which are inserted into the slots or slits of the base part and the bimetallic strip from falling out. The leg-shaped housing projections 49 positioned on the cover part 48, together with a lower edge 55 of the cover part which slightly projects over the lower edge of the base part provide a chamber 61 in which the bimetallic member is housed, being effectively ventilated and coupled to the heating in a thermally effective manner, while being protected against contact, because it is electrically conductive. The projections fix the overheating safety switch 16 because they rest on the lower side of the heating and they ensure a precise spacing of the bimetallic member from the heating means. The projections have a relatively small cross-section in order to keep their thermal mass low. They also form a mechanical protection for the bimetallic member.

The lead-through passages 52 which have already been mentioned project through the cover part, so that the connecting wires 15 may be passed through the cover 18 without the risk of contacting other conducting parts.

Figure 5:
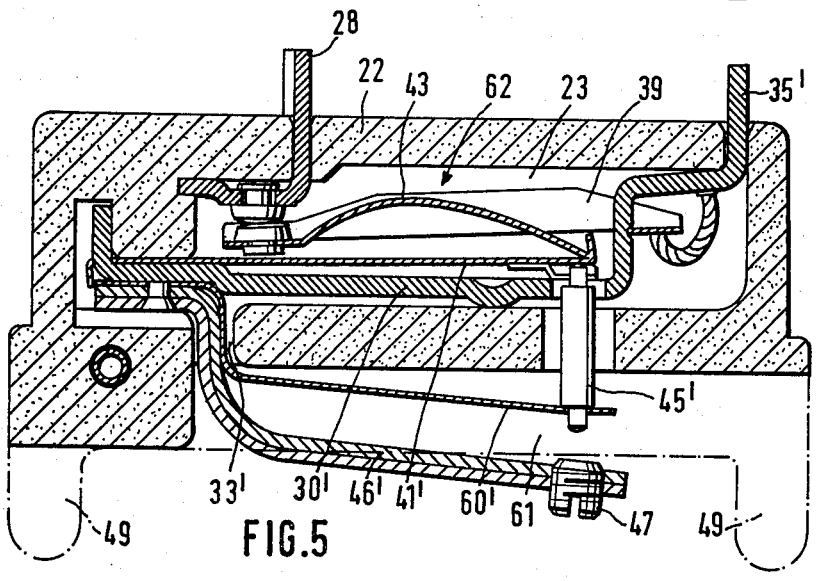
FIG. 5 illustrates an alternative embodiment in section corresponding to FIG. 2.

The overheating safety switch illustrated in FIG. 5 is the same as the switch according to FIG. 2 except for the following differences: the snap switch support 30 leads out of the housing with one end through a slot or slit to the side remote from the bimetallic member, is fixed thereby and forms a connection tongue 35' for the current supply. The other end is also angled and is positioned in a slit which, however, lies inside the housing. The bimetallic member is substantially Z shaped and is riveted onto the snap switch support 30' on the shorter leg of the Z. The center part of the bimetallic member 46' leads through a slit 33' out of the housing into the chamber 61 in which by the far the greatest part of the bimetallic member length extends substantially parallel to the longitudinal extension of the switch in the form of the other leg of the Z. This arrangement further increases the effective length of the bimetallic member and also keeps the snap switch support remote from the hot region, so that the penetration of heat into the recess 23 by thermal conduction is reduced.

The plate spring 60' has substantially the same Z-shape as the bimetallic member, is likewise secured to the snap switch support 30' and is positioned between the support or the housing and the bimetallic member. It has an opening at its end, through which projects a tapered peg of the rod-shaped transmission member 45'. The other end of the transmission pin 45' is off-set in the same manner and projects through an opening in a component part secured on the resilient tongue 41', so that the transmission rod is fixed under pressure between the plate spring 60' and the resilient tongue 41', which guide it in the manner of a parallelogram. The plate spring 60' presses against the force of this resilient tongue or the snap spring tongue 43 and prestresses it. When the end of the bimetallic member comes onto the external end of the transmission rod 45', both forces are added together, so that even greater switching forces of the snap switch 63 may be overcome without an excessive strain on the bimetallic member. Possible switching inaccuracies caused by the transmission pin wobbling are ruled out due to the force-locking parallelogram guidance. During normal operation, i.e. when the hot plate is not overheated, the bimetallic member is free of forces and thus is not exposed to a continuous strain which could result in a bending action. Furthermore, a simple adjustment of the switch is possible due to the secure position of the transmission pin, by passing an adjusting wedge between the adjusting screw 47 and the transmission pin 45', so that the required switching temperature may be adjusted with a small adjustment of the short adjusting screw.

We claim:

1. An electric hotplate with an overheating safety switch which rests on the lower heated side of a hotplate body and is positioned in the heated annular zone of the hotplate, the safety switch including a bimetallic strip and a snap switch mounted in a chamber inside an extended housing and actuatable by the bimetallic strip, the housing projecting through a cover on the lower side of the hotplate body, the safety switch being urged against the lower side of the hotplate body by the cover and having connections for the snap switch and at least one lead-through passage for at least one connection line of the hotplate which is not controlled by the snap switch, comprising: projections on the housing having ends which rest against the lower side of the hotplate body and form an open chamber outside the housing; a transmission member projecting through an opening in the housing; and, the bimetallic strip being disposed in the open chamber formed by the housing projections, extending lengthwise with the housing extension and acting on the transmission member, which transmits deflections of the bimetallic strip to the snap switch.

2. The electric hotplate according to claim 1, wherein the housing comprises a base part and a cover part, the chamber accommodating the snap switch in the base part being formed by a recess which is open at the sides and is sealed by the cover part fitted on the sides.

3. The electric hotplate according to claim 2 wherein the cover part comprises the housing projections which rest on the lower side of the hot plate.

4. The electric hotplate according to claim 1, wherein the housing projections are two feet having a small cross-section and bordering on the two narrow sides of the housing.

5. The electric hotplate according to claim 2, wherein the cover part is provided with a plurality of lead-through passages, in the form of adjacent and continuous holes, for the connection lines.

6. The electric hotplate according to claim 2, wherein the component parts of the snap switch and the bimetallic member are fixed by being inserted laterally into slots formed in the base part of the housing and are secured by attachment of the cover part.

7. The electric hotplate according to claim 2, wherein the bimetallic strip is secured to a snap switch support projecting through a slot in the base part of the housing, supporting the movable contact of the snap switch and forming the current supply thereof.

8. The electric hotplate according to claim 1, wherein the transmission member is pressed against the snap switch actuation point with contact pressure by a plate spring which is positioned substantially parallel to the bimetallic strip.

9. The electric hotplate according go claim 8, wherein the transmission member is pin-shaped.

10. The electric hotplate according to claim 8, wherein the end of the transmission member facing the snap switch is fixed against lateral movements by the snap switch.

11. The electric hotplate according to claim 1, wherein the bimetallic strip is of Z-shape, is fixed inside the housing on a snap switch support supporting the movable contact of the snap switch and forming the current supply thereof, and projects into the chamber through an opening in the housing.

* * * * *

UNITED STATES PATENT AND TRADEMARK OFFICE

CERTIFICATE OF CORRECTION

PATENT NO. : 4,386,263

DATED : May 31, 1983

INVENTOR(S) : Karl Fischer & Felix Schreder

It is certified that error appears in the above-identified patent and that said Letters Patent are hereby corrected as shown below:

Column 2, line 63, delete "rapdily" and insert --rapidly--.

Column 5, line 44, between "by" and "far" delete "the".

Signed and Sealed this

*Third* Day of *April 1984*

[SEAL]

*Attest:*

GERALD J. MOSSINGHOFF

*Attesting Officer*

*Commissioner of Patents and Trademarks*